US005899797A

United States Patent [19]

Junker

[11] Patent Number: 5,899,797

[45] Date of Patent: May 4, 1999

[54] METHOD AND APPARATUS FOR GRINDING CAMS WITH CONCAVE SIDES

[76] Inventor: Erwin Junker, Junkerstrasse 2, D-77787 Nordrach, Germany

[21] Appl. No.: 08/776,624

[22] PCT Filed: Jun. 26, 1995

[86] PCT No.: PCT/EP95/02490

§ 371 Date: Jan. 23, 1997

§ 102(e) Date: Jan. 23, 1997

[87] PCT Pub. No.: WO96/03257

PCT Pub. Date: Feb. 8, 1996

[30] Foreign Application Priority Data

Jul. 26, 1994 [DE] Germany ..... 44 26 452

[51] Int. Cl.[6] ..... B24B 1/00

[52] U.S. Cl. ..... 451/62; 451/242; 451/246; 451/251

[58] Field of Search ..... 451/62, 242, 246, 451/249, 251, 49, 51

[56] References Cited

U.S. PATENT DOCUMENTS

| | | | |
|---|---|---|---|
| 1,843,301 | 2/1932 | Player et al. | 451/62 |
| 2,209,538 | 7/1940 | Rabe | 451/62 |
| 5,355,633 | 10/1994 | Ishikawa et al. | 451/62 |
| 5,392,566 | 2/1995 | Wedeniwski | 451/62 |
| 5,655,952 | 8/1997 | Schunn et al. | 451/62 |
| 5,697,831 | 12/1997 | Reichel | 451/251 |

FOREIGN PATENT DOCUMENTS

| | | |
|---|---|---|
| 678981 | 7/1939 | Germany . |
| 3435313 | 9/1985 | Germany . |
| 4034146 | 5/1991 | Germany . |
| 41 37924 | 2/1993 | Germany . |
| 2218547 | 8/1990 | Japan . |
| 2208275 | 3/1989 | United Kingdom . |

*Primary Examiner*—Eileen P. Morgan
*Attorney, Agent, or Firm*—Jordan and Hamburg, LLP

[57] ABSTRACT

A grinding machine includes a bed, structure for supporting a camshaft on the bed, a carriage displaceably mounted on the bed to permit movement relative to the camshaft in a radial direction of the camshaft, first and second grinding spindles respectively having a rough-grinding disc and a finish-grinding disc, a headstock having the first and second grinding spindles mounted therein and the first and second grinding spindles respectively having first and second spindle axes aligned to intersect each other at an angle. The second grinding spindle also has a third grinding which has a third diameter smaller than a first diameter of the rough-grinding disc, greater than a second diameter of the finish-grinding disc and equal to substantially twice a concavity radius and of a cam to be ground and a width narrower than a cam width. A method of grinding the cam includes first rough grinding the cam from an untreated configuration using the rough-grinding disc to an intermediate configuration using the rough-grinding disc, then rough grinding the cam to a modified intermediate configuration using the third grinding disc, wherein the modified intermediate configuration defines a concave side of the cam, by pivoting the headstock and advancing the third grinding disc against the cam in a longitudinal direction corresponding to the camshaft axis with the third grinding disc set at a depth substantially corresponding to a depth of the concavity, and finally finish grinding the cam by grinding the cam using the finish-grinding disc.

19 Claims, 4 Drawing Sheets

-7-

METHOD AND APPARATUS FOR GRINDING CAMS WITH CONCAVE SIDES

BACKGROUND OF THE INVENTION

The invention relates to a method and an apparatus for grinding cams of a camshaft, which cams comprise concave sides.

A method for grinding cams is described in DE 41 37 924 C1. In this method, a cam is initially rough-ground in a first step from an untreated configuration to an intermediate configuration with a first, large grinding disc. Subsequently, in a plunge-cut grinding method, a modified intermediate configuration, corresponding to the concave sides, is produced by a second grinding disc of smaller diameter. The cam is then finish-ground with the same grinding disc and thereby brought to its final configuration. The use of a small grinding disc, which is wider than the cam, to produce the modified intermediate configuration means that optimum cooling cannot occur because the grinding disc is engaged in the whole three-dimensional region of the concave side and, hence, in the grinding zone.

SUMMARY OF THE INVENTION

The basic object of the invention is to develop further a method and an apparatus of the type presumed to be known, so that an optimum grinding operation with respect to grinding disc loading and cooling is possible, and so that a modified intermediate configuration with as uniform a dimension as possible for the finish-grinding of the hollow side or respectively of the surface of the cam can be produced.

Briefly stated, the present invention provides a method for grinding a cam of a camshaft, wherein the cam has a concave side defined by a concavity radius and a cam width. The method comprises the following steps. Providing a first grinding disc having a first diameter for rough grinding, a second grinding disc having a second diameter for finish-grinding the cam, and a third grinding disc having a third diameter smaller than the first diameter, greater than the second diameter and equal to substantially twice the concavity radius, the third grinding disc having a width narrower than the cam width. Rough grinding a cam body of the cam from an untreated configuration using the first grinding disc to an intermediate configuration which substantially lacks a concavity conforming to the concave side of the cam. Rough grinding the cam body to a modified intermediate configuration using the third grinding disc, wherein the modified intermediate configuration defines the concave side of the cam, by advancing the third grinding disc relative to the cam body in a longitudinal direction corresponding to a shaft axis of the cam body with the third grinding disc set at a depth substantially corresponding to a depth of the concavity. And finish grinding the cam body using the second grinding disc.

In accordance with the above and other objects of the invention, there is provided a grinding machine for grinding a cam on a camshaft wherein the cam has a concave side defined by a concavity radius and a cam width. The grinding machine comprises a bed, structure for supporting the camshaft on the bed, a carriage displaceably mounted on the bed to permit movement relative to the camshaft in a radial direction of the camshaft, and first and second grinding spindles respectively having a rough-grinding disc and a finish-grinding disc. A headstock has the first and second grinding spindles mounted therein and the first and second grinding spindles respectively have first and second spindle axes aligned in one of a first manner in which the first and second spindle axes intersect each other at an angle and a second manner in which the first and second spindle axes extend parallel to each other. The headstock is mounted on the carriage pivotable about a headstock axis displaced from and extending transversely relative to a camshaft axis of the camshaft. The second grinding spindle has a third grinding disc disposed adjacent the finish-grinding disc. The rough-grinding disc has a first diameter for rough grinding, the finish-grinding disc has a second diameter for finish-grinding the cam, and the third grinding disc has a third diameter smaller than the first diameter, greater than the second diameter and equal to substantially twice the concavity radius. The third grinding disc has a width narrower than the cam width. There are further provided mechanisms for pivoting the headstock, moving the carriage relative to the camshaft along the radial direction of the camshaft, and moving the camshaft along in a direction normal to the radial direction of the camshaft, and a controller for controlling the mechanisms.

The controller is programmed for rough grinding a cam body of the cam from an untreated configuration using the rough-grinding disc to an intermediate configuration by pivoting the headstock and advancing the carriage to grind the cam body using the rough-grinding disc, rough grinding the cam body to a modified intermediate configuration using the third grinding disc, wherein the modified intermediate configuration defines the concave side of the cam, by pivoting the headstock and advancing the third grinding disc relative to the cam body in a longitudinal direction corresponding to the camshaft axis with the third grinding disc set at a depth substantially corresponding to a depth of the concavity, and finish grinding the cam body by grinding the cam body using the finish-grinding disc.

An embodiment of the grinding machine is provided wherein the third grinding disc has a working face with a conical configuration. Alternatively, an embodiment of the grinding machine is provided including a mechanism for disposing the second grinding spindle at an angle to the camshaft axis which differs from 0° when the third grinding disc is used.

According to the invention, it is paramount that the grinding disc serving to produce the modified intermediate configuration has a narrower grinding coating than the cam width, an intermediate configuration being ground in the longitudinal direction of this grinding disc when the cam is radially stationary. Thus the modified intermediate configuration is produced in as small a grinding zone as possible between the grinding disc and the cam, so that optimum cooling is achieved.

The grinding disc, which serves to grind-out the modified intermediate configuration in the concave region of inlet and outlet zones of the cam, presents even more advantages.

Since the grinding disc diameter corresponds to approximately twice the radius of the concave side of the cam, the size of the grinding dimension to finish-grind the cam in the concave side is virtually constant when the radius of the side to be ground-out on the cam is substantially constant. Since, in the known method according to DE 41 37 924 C1, the grinding disc for grinding-out the modified intermediate configuration is selected to be substantially greater than twice the radius of the concave side of the cam, a uniform dimension for finish-grinding can never be achieved when grinding-out the modified intermediate configuration. This results necessarily in an increase in the wear on the grinding disc for finish-grinding purposes, as well as in an increase in the grinding time when finish-grinding the external configuration of the cam with the small grinding disc.

The particularly good cooling with the method according to the invention permits high machining outputs and hence a minimum processing time, due to a minimum amount of heat introduced into the grinding zone of the workpiece so that undesirable structural changes, grinding cracks and, hence, a loss of hardness in the surface region of the cam are prevented. The grinding disc, serving to produce the modified intermediate configuration, can be designed for this purpose in optimum manner with respect to grinding disc dimensions and specification, and a grinding disc with an optimum specification and with optimum grinding disc dimensions is also used for finish-grinding. The grinding disc wear is minimized by adapting the grinding disc for producing the intermediate configuration and the grinding disc for finish-grinding to their tasks (roughening and finishing respectively). Also, the additional time needed for trimming the grinding wheels is minimized, because the intervals between trimming become greater. The consumption of grinding wheels, and hence the tool costs, are reduced by the increased intervals between trimming.

Prior to producing the modified intermediate configuration, the cam is rough-ground over its entire circumference by a grinding disc having a relatively large diameter. In such case, the grinding coating of the grinding disc for producing the modified intermediate configuration may be provided with a minimal clearance angle between the workpiece and surface of the grinding disc, as known per se: cf. DE 34 35 313 C2, where a rotationally symmetrical workpiece is processed. Because of the clearance angle, a substantially linear contact between the external face of the grinding coating and the end face of the engaged zone is produced between the completely ground-out configuration of the modified intermediate configuration and the grinding disc during the grinding-out of the modified intermediate configuration, wherein a relatively large quantity of material is machined compared with the finish-grinding of the concave sides. The clearance angle may be produced in such a way that the grinding disc is pivoted horizontally, or in such a way that the grinding disc is trimmed at its surface line to the value of the minimal clearance angle. The desired improvement in the cooling is hereby further promoted.

The apparatus for achieving the object is mentioned in the machine according to the invention permits the grinding discs to be satisfactorily brought into the position of use on the camshaft. The disposition of the grinding spindles on the headstock has the advantage that both spindles are constructed on the same guide (X-axis). Because of this disposition, where two linear guides do not have to be placed one above the other, high values of rigidity are achieved for the grinding carriage. Since the high rigidity of the grinding headstock and the guide system has a positive effect on the accuracy of the workpiece to be produced, optimum accuracy in dimension and configuration can thus be achieved in the finish-ground cam. These high values of rigidity in the guide system increase the operational reliability of the method and, hence, also provide reduced wear on the grinding discs.

BRIEF DESCRIPTION OF THE DRAWINGS

The invention is explained more fully hereinafter with reference to an embodiment illustrated in the drawing. In the drawing.

DETAILED DESCRIPTION OF THE INVENTION

Cams 1 are disposed at spacings on a camshaft 2. The cams must be ground very accurately to their finished configuration, which operation is particularly difficult when—as in the present case—the cams have concave sides.

In FIGS. 1 to 5, an operation is shown using three grinding discs, namely one grinding disc for rough-grinding, one grinding disc for producing the modified intermediate configuration and one grinding disc for finish-grinding.

Figure 1:
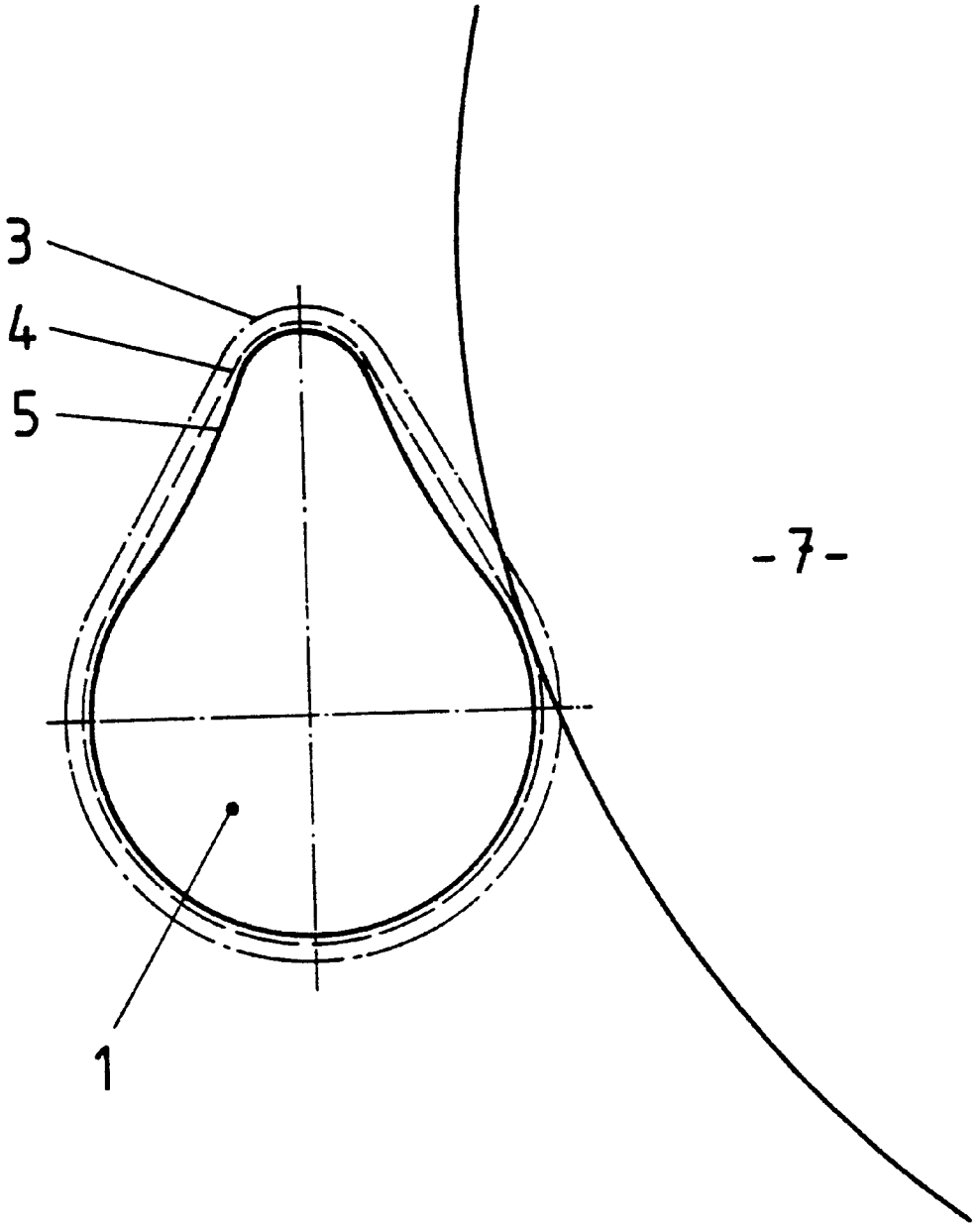
FIG. 1 illustrates the first method step.

The first method step is shown in FIG. 1. The cams 1 are ground with a first grinding disc 7 from their untreated configuration 3 to an intermediate configuration 4. The first grinding disc 7 has a relatively large diameter, for example approximately 400 mm, and it is not possible to grind-out the concave sides because of the flat curvature of the grinding disc associated therewith. For finish grinding a second grinding disc 9 of a smaller diameter is used (compare FIG. 3).

Figure 2:
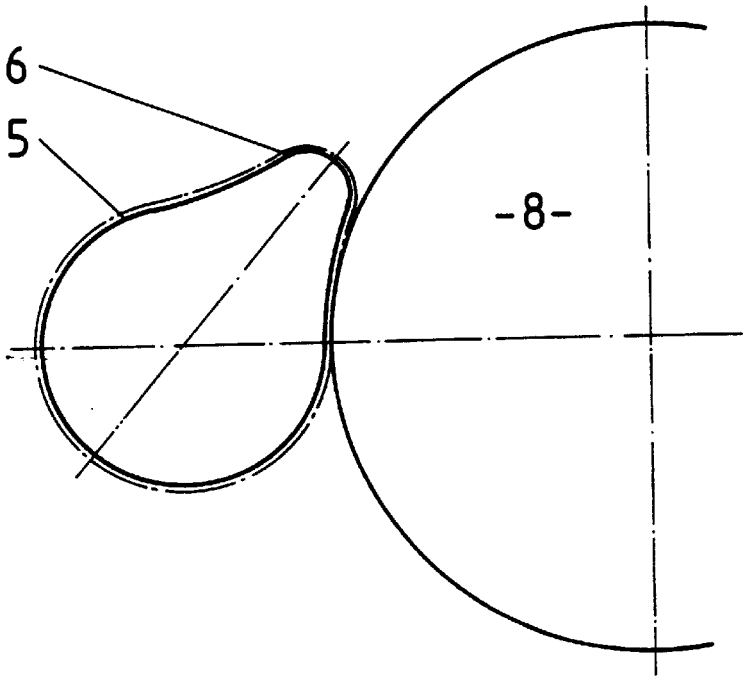
FIG. 2 illustrates the second method step for producing the modified intermediate configuration.
Figure 2A:
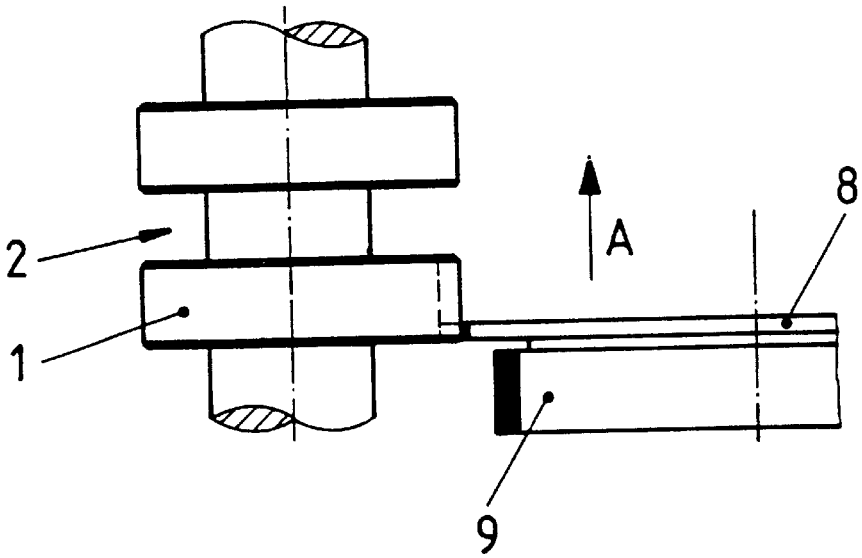
FIG. 2A is a plan view of the arrangement illustrated in FIG. 2.

The method step for grinding-out the concave sides to the modified intermediate configuration is illustrated in FIGS. 2 and 2A. The modified intermediate configuration 6, that is to say the configuration corresponding to the concavity of the sides, is produced by a third grinding disc 8. The grinding disc 8 is more especially substantially narrower with regard to its grinding coating than the width of the cam 1 to be ground. In the embodiment shown, the third grinding disc 8 has a grinding coating width of 4 mm, for example, whereas the cam width for passenger vehicle camshafts is usually between approximately 10 and 20 mm The grinding of the modified intermediate configuration 6 is accomplished with the third grinding disc 8 in such a way that the configuration is ground-out, when the cam 1 is radially stationary, in the longitudinal direction indicated by arrow A. No plunge-cut grinding takes place to grind-out the modified intermediate configuration.

The grinding direction for the grinding-out of the modified intermediate configuration with the grinding disc 8 may be preselected by CNC control on the machine.

the third grinding disc 8 has a diameter which corresponds substantially to twice the concave radius of the concave sides of the cam 1.

The grinding-out of the modified intermediate configuration 6 can be effected by the provision of a clearance angle, whereby a substantially linear contact between the surface line of the grinding disc and the workpiece is achieved.

Figure 3:
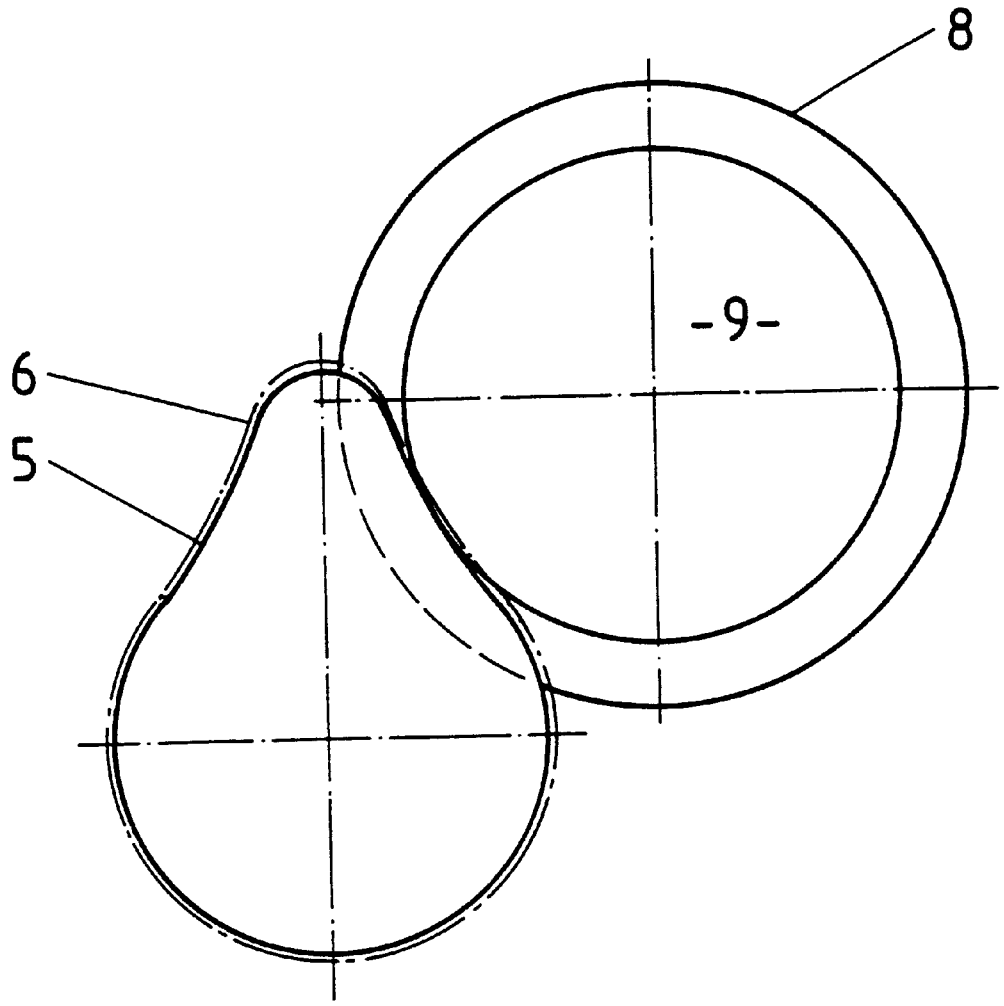
FIG. 3 illustrates the third method step for producing the finished configuration.

The second grinding disc 9, which is always smaller in diameter than the third grinding disc 8, is also mounted on a grinding spindle 13 as is the third grinding disc 8. With this second grinding disc 9 the cam is ground from the modified intermediate configuration 6 to the finished configuration 5, as illustrated in FIG. 3. Because the second grinding disc 9 has a small diameter, the entire external configuration of the cam with the concave sides can easily be ground therewith to its finished dimension.

Figure 4:
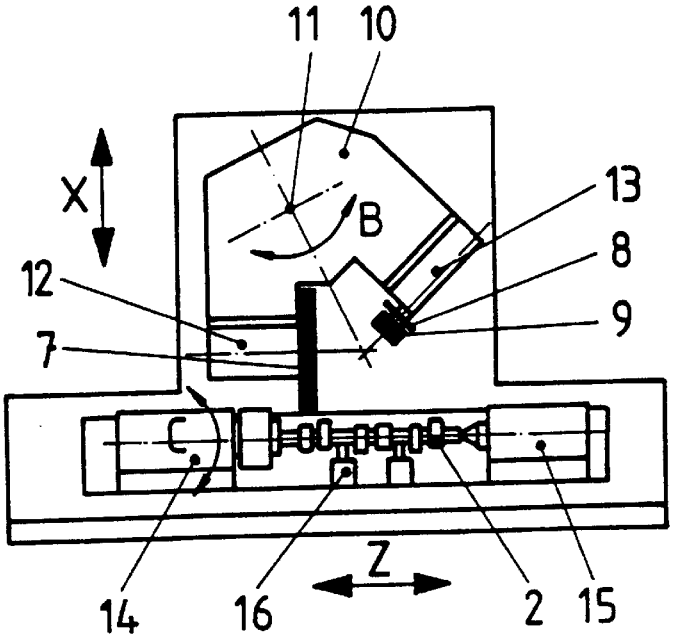
FIG. 4 is a plan view of the apparatus using three grinding discs.
Figure 5:
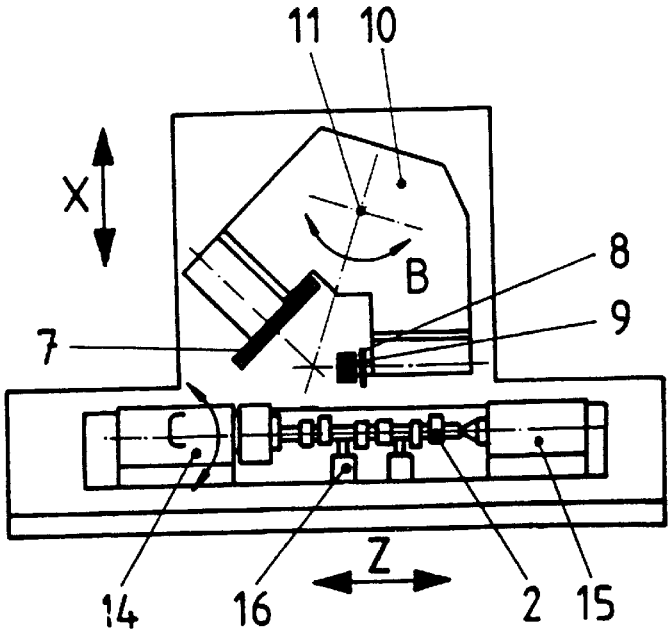
FIG. 5 illustrates the apparatus shown in FIG. 4 after the headstock has been pivoted.

FIGS. 4 and 5 illustrate the entire grinding apparatus with the three grinding discs 7, 8 and 9.

The camshaft 2 is clamped in position between a workpiece headstock 14 and a tailstock 15 and supported at the mounting locations of the camshaft by rests 16.

According to FIGS. 4 and 5, the grinding spindles 12 and 13 with a headstock 10 are pivotable, as indicated by the arrow line B. The pivoting is effected through an angle of 60°, for example, however, the disposition of the grinding spindles also allows other angles, e.g. 180°.

Two grinding spindles 12 and 13 respectively are disposed on the headstock 10 which is mounted on a grinding carriage. The first grinding disc 7, which is shown in FIG. 4 in the grinding position, is mounted on the grinding spindle 12, while the set of grinding discs, mounted on the second grinding spindle 13 and comprising the second grinding disc 9 and the third grinding disc 8, is pivoted away from the workpiece.

FIG. 5 shows the apparatus after the headstock 10 has been pivoted. Now the grinding discs 8 and 9 are in the grinding position, while the first grinding disc 7 is pivoted away.

Beneath the headstock 10 there is the grinding carriage with a guide, and as an extension of the guide there is a digitally controlled drive to raise the cam in the direction of the X-axis in dependence on the rotary movement (C-axis). The longitudinal movement of the camshaft occurs via the Z-axis. The axes of the grinding machine are CNC-controlled.

I claim:

1. A method for grinding a cam of a camshaft, wherein the cam has a concave side defined by a concavity radius and a cam width, the method comprising the steps of:

providing a first grinding disc having a first diameter for rough grinding, a second grinding disc having a second diameter for finish-grinding the cam, and a third grinding disc having a third diameter smaller than the first diameter, greater than the second diameter and equal to substantially twice the concavity radius, the third grinding disc having a width narrower than the cam width;

rough grinding a cam body of the cam from an untreated configuration using the first grinding disc to an intermediate configuration which substantially lacks a concavity conforming to the concave side of the cam;

rough grinding the cam body to a modified intermediate configuration using the third grinding disc, wherein the modified intermediate configuration defines the concave side of the cam, by advancing the third grinding disc relative to the cam body in a longitudinal direction corresponding to a shaft axis of the cam body with the third grinding disc set at a depth substantially corresponding to a depth of the concavity; and finish grinding the cam body using the second grinding disc.

2. The method according to claim 1 wherein the third grinding disc is advanced relative to the cam body in the longitudinal direction corresponding to the shaft axis of the cam body with a grinding face of the third grinding disk disposed at a slant relative to the shaft axis.

3. A grinding machine for grinding a cam on a camshaft wherein the cam has a concave side defined by a concavity radius and a cam width, the grinding machine comprising:

a bed;

means for supporting the camshaft on the bed;

a carriage displaceably mounted on the bed to permit movement relative to the camshaft in a radial direction of the camshaft;

first and second grinding spindles respectively having a rough-grinding disc and a finish-grinding disc;

a headstock having the first and second grinding spindles mounted therein and the first and second grinding spindles respectively having first and second spindle axes aligned in one of a first manner in which the first and second spindle axes intersect each other at an angle and a second manner in which the first and second spindle axes extend parallel to each other;

the headstock being mounted on the carriage pivotable about a headstock axis displaced from and extending transversely relative to a camshaft axis of the camshaft;

the second grinding spindle having a third grinding disc disposed adjacent the finish-grinding disc;

the rough-grinding disc having a first diameter for rough grinding, the finish-grinding disc having a second diameter for finish-grinding the cam, and the third grinding disc having a third diameter smaller than the first diameter, greater than the second diameter and equal to substantially twice the concavity radius, the third grinding disc having a width narrower than the cam width;

first means for pivoting the headstock;

second means for moving the carriage relative to the camshaft along the radial direction of the camshaft;

third means for moving the camshaft along in a direction normal to the radial direction of the camshaft;

a controller for controlling the first means, the second means and the third means;

the controller including means for rough grinding a cam body of the cam from an untreated configuration using the rough-grinding disc to an intermediate configuration which substantially lacks a concavity conforming to the concave side of the cam by pivoting the headstock and advancing the carriage to grind the cam body using the rough-grinding disc;

the controller including means for rough grinding the cam body to a modified intermediate configuration using the third grinding disc, wherein the modified intermediate configuration defines the concave side of the cam, by pivoting the headstock and advancing the third grinding disc relative to the cam body in a longitudinal direction corresponding to the camshaft axis with the third grinding disc set at a depth substantially corresponding to a depth of the concavity; and the controller including means for finish grinding the cam body by grinding the cam body using the finish-grinding disc.

4. The grinding machine according to claim 3, wherein the third grinding disc has a working face with a conical configuration.

5. The grinding machine according to claim 3, further comprising means for disposing the second grinding spindle at an angle to the camshaft axis which differs from 0° when the third grinding disc is used.

6. A grinding machine for grinding a cam from a cam body on a camshaft having a camshaft axis wherein said cam has a concave side defined by a concavity radius and a cam width, said grinding machine comprising:

a bed;

means for supporting said camshaft on said bed;

a headstock mechanism having a rough-grinding disc, a finish-grinding disc, and a third grinding disc;

a transport mechanism for effecting relative movement between said headstock mechanism and said camshaft to selectively engage said rough-grinding disc, said finish-grinding disc, and said third grinding disc with said cam body;

said rough-grinding disc having a first diameter for rough grinding, said finish-grinding disc having a second diameter for finish-grinding said cam, and said third grinding disc having a third diameter smaller than said first diameter, greater than said second diameter and equal to substantially twice said concavity radius, said third grinding disc having a width narrower than said cam width and a grinding face;

a controller for controlling said transport mechanism;

said controller including means for controlling said transport mechanism to effect rough grinding said cam body of said cam from an untreated configuration using said rough-grinding disc to an intermediate configuration which substantially lacks a concavity conforming to said concave side of said cam;

said controller including means for controlling said transport mechanism to effect rough grinding said cam body to a modified intermediate configuration using said third grinding disc, wherein said modified intermediate configuration defines said concave side of said cam, by contacting said cam body with said grinding face of said third grinding disc at a slant relative to said camshaft axis and advancing said third grinding disc relative to said cam body in a longitudinal direction corresponding to said camshaft axis with said third grinding disc set at a depth substantially corresponding to a depth of said concavity; and said controller including means for controlling said transport mechanism to effect finish grinding said cam body by grinding said cam body using said finish-grinding disc.

7. The grinding machine according to claim 6 wherein said transport mechanism includes:

a carriage supporting said headstock mechanism and displaceably mounted on said bed to permit movement relative to said camshaft in a radial direction of said camshaft;

carriage actuation means for moving said carriage relative to said camshaft along said radial direction of said camshaft; and camshaft positioning means for effecting movement of said camshaft in a direction parallel to said camshaft axis relative to said headstock mechanism.

8. The grinding machine according to claim 7 wherein said transport mechanism includes:

said headstock mechanism being mounted on said carriage pivotable about a headstock axis displaced from and extending transversely relative to said camshaft axis of said camshaft; and pivoting means for pivoting said headstock mechanism to effect selective engagement of said rough-grinding disc, said finish-grinding disc, and said third grinding disc with said cam body.

9. The grinding machine according to claim 8 wherein:

said headstock mechanism has first and second grinding spindles mounted therein for driving said rough-grinding disc, said finish-grinding disc, and said third grinding disc; and said first and second grinding spindles are disposed in said headstock mechanism to permit selective engagement of said rough-grinding disc, said finish-grinding disc, and said third grinding disc with said cam body by pivoting of said headstock mechanism.

10. The grinding machine according to claim 9 wherein said first and second grinding spindles respectively have first and second spindle axes aligned relative to each other at an angle.

11. The grinding machine according to claim 10 wherein:

said first and second grinding spindles respectively have said rough-grinding disc and said finish-grinding disc disposed thereon; and said second grinding spindle has said third grinding disc disposed adjacent said finish-grinding disc.

12. The grinding machine according to claim 11 wherein said grinding face of said third grinding disc is conical to effect contacting said cam body with said grinding face at said slant relative to said camshaft axis.

13. The grinding machine according to claim 11 wherein said grinding face of said third grinding disc is straight and said transport mechanism includes camshaft rotating means for rotating said camshaft relative to said grinding face to effect contacting said cam body with said grinding face at said slant relative to said camshaft axis.

14. The grinding machine according to claim 6 wherein said grinding face of said third grinding disc is conical to effect contacting said cam body with said grinding face at said slant relative to said camshaft axis.

15. The grinding machine according to claim 14 wherein said transport mechanism includes:

a carriage supporting said headstock mechanism and displaceably mounted on said bed to permit movement relative to said camshaft in a radial direction of said camshaft;

carriage actuation means for moving said carriage relative to said camshaft along said radial direction of said camshaft; and camshaft positioning means for effecting movement of said camshaft in a direction parallel to said camshaft axis relative to said headstock mechanism.

16. The grinding machine according to claim 15 wherein said transport mechanism includes:

said headstock mechanism being mounted on said carriage pivotable about a headstock axis displaced from and extending transversely relative to said camshaft axis of said camshaft; and pivoting means for pivoting said headstock mechanism to effect selective engagement of said rough-grinding disc, said finish-grinding disc, and said third grinding disc with said cam body.

17. The grinding machine according to claim 6 wherein said grinding face of said third grinding disc is straight and said transport mechanism includes camshaft rotating means for rotating said camshaft axis relative to said grinding face to effect contacting said cam body with said grinding face at said slant relative to said camshaft axis.

18. The grinding machine according to claim 17 wherein said transport mechanism includes:

a carriage supporting said headstock mechanism and displaceably mounted on said bed to permit movement relative to said camshaft in a radial direction of said camshaft;

carriage actuation means for moving said carriage relative to said camshaft along said radial direction of said camshaft; and camshaft positioning means for effecting movement of said camshaft in a direction parallel to said camshaft axis relative to said headstock mechanism.

19. The grinding machine according to claim 18 wherein said transport mechanism includes:

said headstock mechanism being mounted on said carriage pivotable about a headstock axis displaced from and extending transversely relative to said camshaft axis of said camshaft; and pivoting means for pivoting said headstock mechanism to effect selective engagement of said rough-grinding disc, said finish-grinding disc, and said third grinding disc with said cam body.

* * * * *